US007753359B2

(12) United States Patent
Suzuki

(10) Patent No.: US 7,753,359 B2
(45) Date of Patent: Jul. 13, 2010

(54) SHEET CONVEYANCE APPARATUS AND IMAGE FORMING APPARATUS

(75) Inventor: Tomoo Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 78 days.

(21) Appl. No.: 11/873,940

(22) Filed: Oct. 17, 2007

(65) Prior Publication Data

US 2008/0136085 A1 Jun. 12, 2008

(30) Foreign Application Priority Data

Dec. 6, 2006 (JP) ..... 2006-329181

(51) Int. Cl.
*B65H 3/06* (2006.01)

(52) U.S. Cl. ..... 271/109; 271/119; 492/36

(58) Field of Classification Search ..... 271/109, 271/119; 492/36
See application file for complete search history.

(56) References Cited

U.S. PATENT DOCUMENTS 5,129,876 A * 7/1992 Brabant et al. ..... 493/471
5,455,296 A * 10/1995 Ikeda et al. ..... 524/588
5,797,827 A * 8/1998 Sondergeld ..... 492/37
6,196,958 B1 * 3/2001 Shiraki et al. ..... 492/59
7,374,527 B2 * 5/2008 Minagoshi ..... 492/30
7,470,327 B2 * 12/2008 Ooshima et al. ..... 118/123
2002/0130460 A1 * 9/2002 Yoshida et al. ..... 271/121
2002/0166234 A1 * 11/2002 Hyllberg et al. ..... 29/895.3
2004/0152575 A1 * 8/2004 Kaji et al. ..... 492/56
2005/0049127 A1 * 3/2005 Nagata ..... 492/30
2005/0119097 A1 * 6/2005 Nishimori ..... 492/56
2006/0082052 A1 * 4/2006 Noda ..... 271/314
2007/0244285 A1 * 10/2007 Minagoshi ..... 526/335
2007/0257424 A1 * 11/2007 Okazaki ..... 271/264
2008/0061495 A1 * 3/2008 Shiraki ..... 271/119

FOREIGN PATENT DOCUMENTS

JP 10181896 A * 7/1998
JP 2000128377 A * 5/2000

* cited by examiner

*Primary Examiner*—Patrick Mackey
*Assistant Examiner*—Jeremy Severson
(74) *Attorney, Agent, or Firm*—Finnegan, Henderson, Farabow, Garrett & Dunner, L.L.P.

(57) ABSTRACT

A sheet conveyance apparatus having: a conveyance roller, wherein a surface roughness Ra of a surface layer remains in a range from 8 μm to 30 μm, at a stage where a total length of sheets conveyed reaches at 42,000 m.

6 Claims, 7 Drawing Sheets

FIG. 6 ( a ) PROFILE 1
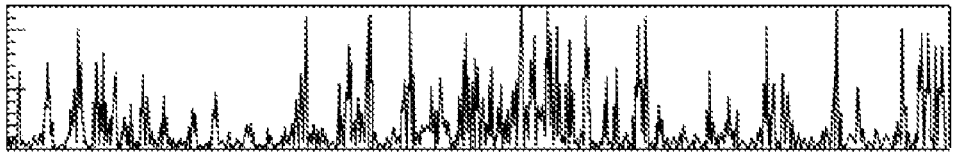
Ra: 16.624(μm)
FIG. 6 ( b ) PROFILE 2
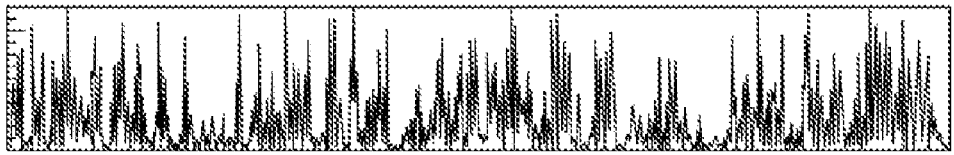
Ra: 23.714(μm)
FIG. 7 ( a ) PROFILE 1
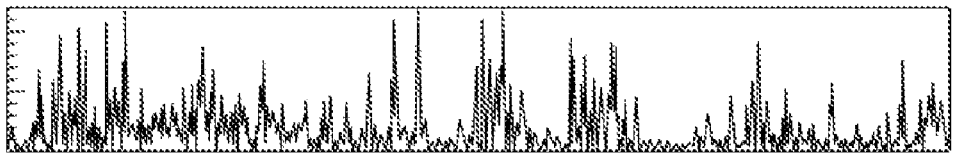
Ra: 13.202(μm)
FIG. 7 ( b ) PROFILE 2
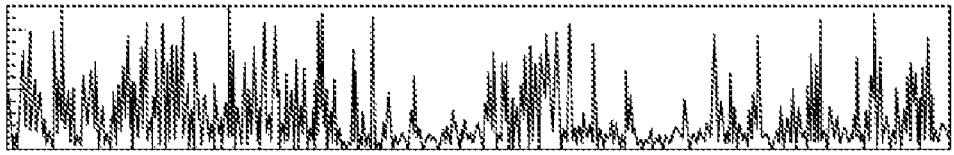
Ra: 18.369(μm)

FIG. 8 ( a ) PROFILE 1
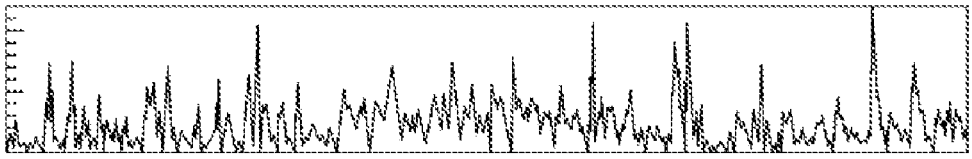
Ra: 5.868(μm)
FIG. 8 ( b ) PROFILE 2
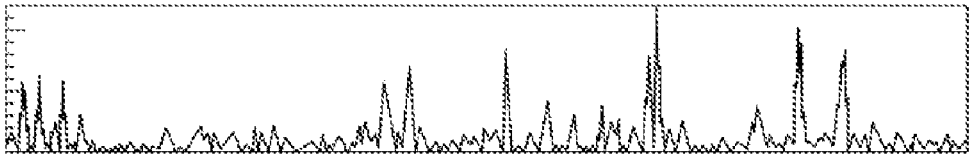
Ra: 8.130(μm)
FIG. 9 ( a ) PROFILE 1
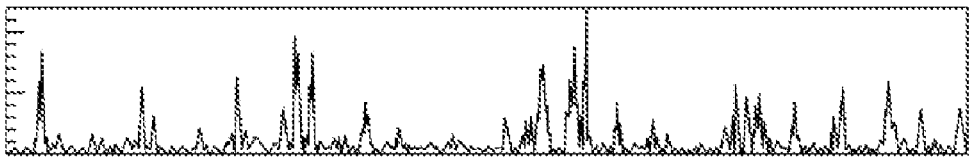
Ra: 5.547(μm)
FIG. 9 ( b ) PROFILE 2
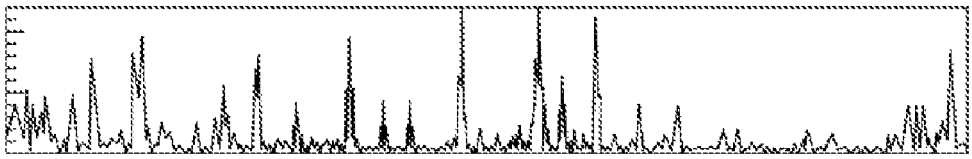
Ra: 4.700(μm)

SHEET CONVEYANCE APPARATUS AND IMAGE FORMING APPARATUS

This application is based on Japanese Patent Application No. 2006-329181 filed on Dec. 6, 2006, in Japanese Patent Office, the entire content of which is hereby incorporated by reference.

BACKGROUND OF THE INVENTION

The present invention relates to: a sheet conveyance apparatus used in a post-processing apparatus which carries out post-processing for a sheet on which an image is formed by an image forming apparatus such as a copying machine, a facsimile machine, a printer and a scanner, a paper currency counting apparatus, and a mail sorting apparatus; and to an image forming apparatus having the sheet conveyance apparatus.

In the sheet conveyance apparatus, a deterioration of conveyance performance of a conveyance roller in pressure-contact with a sheet to convey the sheet due to a deterioration with time and particularly wear has been problems, and countering measures for the deterioration and wear have been studied.

In the Patent Document 1, it is suggested that a surface roughness Rz of a rubber roller is made 3 to 100 μm and an average tread interval Sm is made 15 to 200 μm to improve a durability of a conveyance force.

In the Patent Document 2, it is suggested that a rough surface roller is imposed onto the conveyance roller so as to print a rough surface pattern of the rough surface roller onto a surface of the conveyance roller in conveyance operation, thereby the deterioration of a friction resistance on the conveyance roller surface is prevented.

Patent document 1: Tokkaihei 10-181396

Patent document 2: Tokkai 2000-128377

In the sheet conveyance apparatus using the conveyance roller to convey the sheet, it is a problem that there is occurred a failure of conveyance such as slip due to the deterioration of conveyance force of the conveyance roller caused by the deterioration of the friction resistance of the conveyance roller.

Conventionally, when designing a sheet conveyance apparatus, to maintain a necessary conveyance force during a life span or a maintenance interval of the apparatus, initial values of roller characteristic such as surface roughness were determined based on experiences and accumulated data concerning deterioration with age of the conveyance force, and a material of the conveyance roller and surface treatment were determined to realize such initial values.

In such a design method, the necessary durability for the conveyance roller has been maintained by controlling the initial values of characteristic of the conveyance roller represented by the surface roughness.

However, by such design method, it has been becoming difficult to maintain necessary conveyance force for a long period of time.

Previously, in most cases, plain paper had been used for copying machines and printers, however in recent years for image forming apparatuses adaptable for POD (print on demand) market, a coated paper on which surface a coat layer is being formed, is popularly used besides the plain paper.

In the coated paper, a coating material including a pigment or a resin is applied on a surface of a pulp textile, thus when a impact is given, the coat material is easily broken away and paper powder having a diameter of 1 to 5 μm is created.

In sheet conveyance through the conveyance roller having a rubber surface layer, such paper powder is created by impact, then adheres and accumulates on the roller surface.

Since the paper powder adhered on the roller surface can be transferred from the roller surface to the sheet, an amount of the paper powder accumulates on the roller surface is determined by amounts of the paper powder transferred from the sheet to the roller surface and from the roller surface to the sheet. Therefore, when accumulation of the paper powder reaches to a certain level, these amounts become an equilibrium state, and the amount of the paper powder on the roller surface is saturated.

Even in such saturated state, if a surface not covered by the paper powder mainly including the coat material, namely a rubber surface is maintained on the roller surface, slip does not occur in conveyance of the coated paper.

In the saturated condition, the amount of paper powder adhering on the roller surface varies with environmental conditions such as a temperature, a humidity, and a kind of the sheet conveyed, however, the amount of the paper powder causing occurrence of slip varies with a micro structure of the surface of the conveyance roller. Therefore, the rougher condition of the rubber roller surface where a large number of micro convexo-concaves are provided can ensure the more area of the rubber surface where the paper powder including the coating material does not cover, even if the paper powder adheres on the roller surface. Accordingly, a degree of the friction resistance deterioration of the conveyance roller on which the conveyance force depends can be suppressed to lower level as more convexo-concaves are formed and the rougher surface is made.

The Patent Document 1 suggests to provide the micro convexo-concaves on the conveyance roller surface so as to suppress adhesion of the paper powder. Namely, in Patent Document 1, when the conveyance roller made up of rubber is formed, the surface of the roller is formed with the surface roughness RZ of 3 to 100 μm and the average tread distance of 15 to 200 μm.

In the above, the necessary conveyance force can be ensured at the beginning, however at a point of time where the diameter of the roller reduced by 400 μm (0.4 mm) due to a friction of roller surface, the convexo-concaves on the conveyance roller surface disappear and the conveyance force is deteriorated.

A wearing speed of the conveyance roller used particularly in a feeding separating mechanism which separates and feeds the sheet one by one is high. Thus in case of EPDM rubber roller generally used having a robber hardness of approximately 35 degree and a diameter of 30 mm, the conveyance force decreases before 50,000 pieces of A4 sheets are conveyed.

Since the interval of maintenance is set at around pieces in most cases, the sheet conveyance apparatus in Patent Document 1 cannot prevent slip due to insufficient conveyance force. Further in an image forming apparatus having the maintenance interval of 300,000 pieces, insufficient conveyance force is a serious problem.

Therefore, though the initial characteristic values are determined at appropriate values, it is difficult to realize the sheet conveyance apparatus without the occurrence of the conveyance failure for a long period of time.

In Patent document 2, a countermeasure based on study of the wear of the conveyance roller by plain paper is employed. Thus, in the patent document 2, there is suggested a grinding roller in contact with the roller surface to maintain the convexo-concaves even after the wear is progressed.

However, the countermeasure in Patent document 2 cannot maintain a sufficient conveyance force after passing a number of the sheets.

Also, such countermeasure for the wear of the roller is effective on some level for conveyance of the plain paper, however, it is not so effective against slip occurs when the coated paper is used.

SUMMARY OF THE INVENTION

An object of the present invention is to provide a sheet conveyance apparatus having a sufficient conveyance force for various kinds of paper during the life time or the maintenance interval of the apparatus, and an image forming apparatus having the sheet conveyance apparatus thereof.

The above object can be achieved by the following:

A sheet conveyance apparatus having a conveyance roller which is in contact with a sheet with pressure to convey the sheet, wherein the conveyance roller has a surface layer made up of rubber and a surface roughness Ra of the surface layer remains in a range from 8 μm to 30 μm at a stage where a length of the sheets conveyed reaches at a total of 42,000 m.

BRIEF DESCRIPTION OF THE DRAWINGS

FIG. 6 is a diagram showing a surface state of a conveyance roller of a sheet conveyance apparatus related to an embodiment of the present invention after 200,000 sheets are conveyed.

FIG. 7 is a diagram showing an unused surface state of a conveyance roller, of which surface is processed.

FIG. 8 is a diagram showing a surface status of a conveyance roller of a comparison example 1.

FIG. 9 is a diagram showing a surface status of a conveyance roller of a comparison example 2.

DETAILED DESCRIPTION OF THE PREFERRED EMBODIMENT

Figure 1:
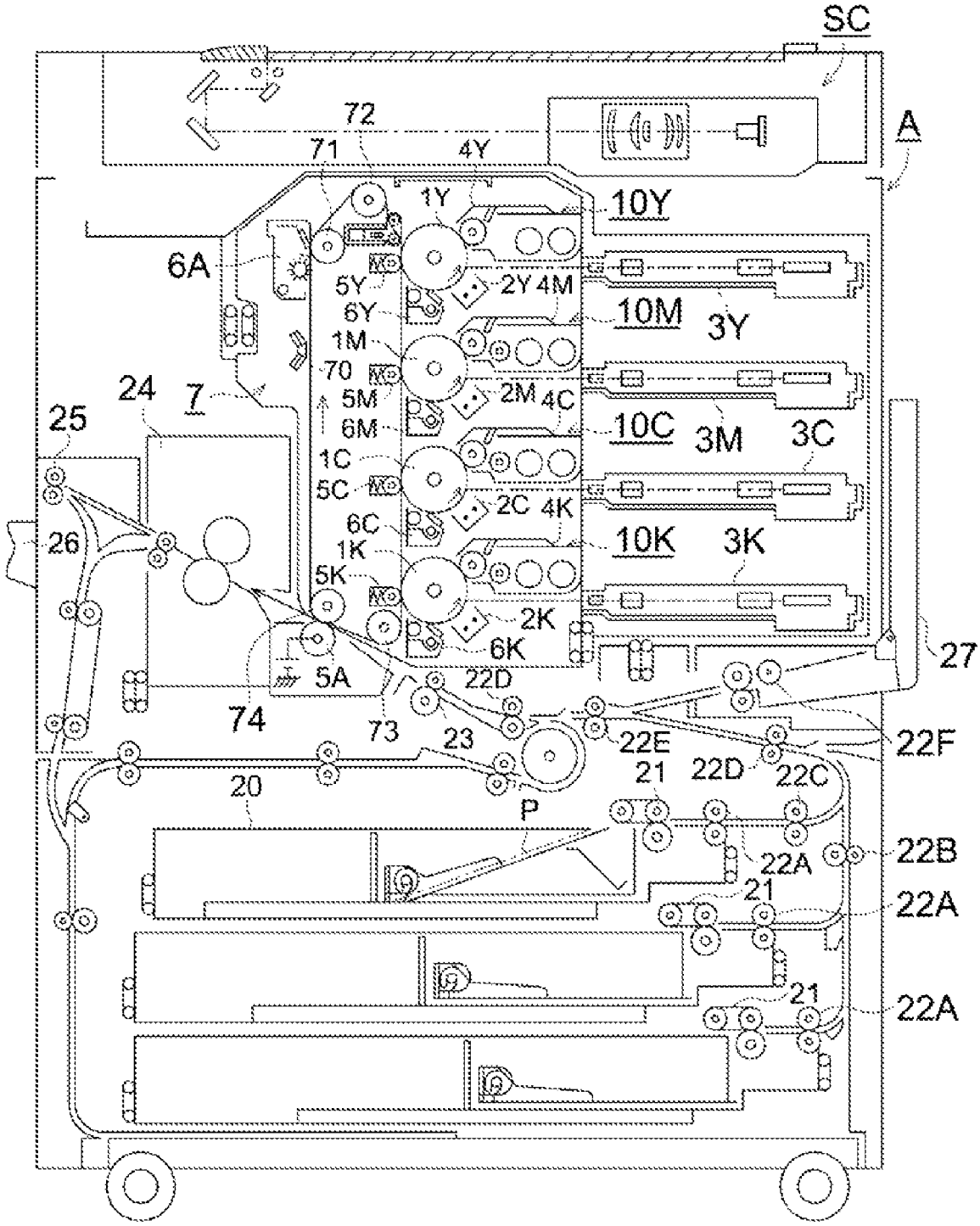
FIG. 1 is a view showing a total structure of a image forming apparatus related to an embodiment of the present invention.

The following describes the present invention with reference to embodiments, without the present invention being restricted thereto;

FIG. 1 is a view showing a total structure of an image forming apparatus related to an embodiment of the present invention.

This image forming apparatus is so-called a lateral tandem structure full color image forming apparatus, which is configured with a plurality of image forming sections 10Y, 10M, 10C and 10K, an intermediate transfer unit 7 in a shape of endless belt, a sheet feeding section 21, and a fixing device 24. Above a main body A of the image forming apparatus, a document reading device SC is disposed.

The image forming section 10Y to form an image of yellow color has a photoconductive member 1Y in a drum shape, a charging device 2Y arranged at a peripheral of the photoconductive member 1Y, an exposing device 3Y, a developing device 4Y, a primary transfer roller 5Y, and a cleaning device 6Y. The image forming section 10Y to form an image of magenta color has a photoconductive member 1M in a drum shape, a charging device 2M arranged at a peripheral of the photoconductive member 1M, an exposing device 3M, a developing device 4M, a primary transfer roller 5M, and a cleaning device 6M. The image forming section 10C to form an image of cyan color has a photoconductive member 1C in a drum shape, a charging device 2C arranged at a peripheral of the photoconductive member 1C, an exposing device 3C, a developing device 4C, a primary transfer roller 5C, and a cleaning device 6C. The image forming section 10Y to form an image of black color has a photoconductive member 1K in a drum shape, a charging device 2K arranged at a peripheral of the photoconductive member 1K, an exposing device 3K, a developing device 4K, a primary transfer roller 5K, and a cleaning device 6K.

The intermediate transfer unit 7 has an intermediate transfer substance 70 in a shape of an endless belt having semi conductive property, which trains about a plurality of rollers to be supported rotatably.

The images of respective colors formed by the image forming sections 10Y, 10M, 10C and 10K are transferred subsequently onto the intermediate transfer substance 70 being in rotation through the primary transfer rollers 5Y, 5M, 5C and 5K thus a superimposed color image is formed. A sheet P stored in a sheet feeding cassette 20 is fed through a sheet feeding section 21 and transferred to a resist roller 23 through a pre-resist roller 22A and intermediate rollers 22B-22E. In the resist roller 23, the sheet P is synchronised with image forming of the image forming sections 10Y, 10M, 10C and 10K and conveyed to a second transfer roller 5A, then a color image is transferred onto the sheet P at one time. The sheet P on which the color image has been transferred is treated with fixing process by fixing device 24 and grasped by discharging rollers 25 and then loaded on a sheet discharging tray 26 outside the apparatus.

In order to correct a skew of the sheet P, the pre-registration roller 22A receives the sheet P conveyed from the sheet feeding section 21 in a stopped state so that the sheet P forms a loop (buckle) on the upstream side of the pre-registration roller 22A, thereafter the pre-registration roller 22A starts to convey the sheet P.

A sheet feeding section 22F separates one sheet from a pile of the sheets on a manual sheet feeding section 27.

On the other hand, after the color image is transferred onto the sheet P through the secondary transfer roller 5A, the sheet P is separated from the intermediate transfer substance 70 thereafter the intermediate transfer substance 70 is cleaned by cleaning device 6A so as to remove remaining toner.

During image forming process, a primary roller 5K always presses the photoconductive substance 1K. Other rollers 5Y, 5M and 5C press corresponding photoconductive substances 1Y, 1M and 1C respectively only when the color image is formed.

The secondary roller 5A presses the intermediate transfer substance 70 while secondary transfer is carried out on the sheet P.

The image forming sections 10Y, 10M, 10C and 10K are disposed tandem in a vertical direction. The intermediated transfer unit 7 is arranged in a left side of the photoconductive substances 1Y, 1M, 1C and 1K in the figure. The intermediated transfer unit 7 includes: the rotatable intermediate transfer substance 70 which trains about rollers 71, 72, 73, 74, 76 and 77; primary transfer rollers 5Y, 5M, 5C and 5K; and the cleaning device 6A.

On the photoconductive substances 1Y, 1M, 1C, and 1K, electro static latent images are formed through the charging devices (2Y, 2M, 2C and 2K) and the developing devices (3Y, 3M, 3C and 3K), then toner images are formed through development by developing devices (4Y, 4M, 4C and 4K). The toner images for respective colors are superimposed on the intermediated transfer substance 70 through primary transfer then the superimposed toner image is secondary transferred onto the sheet P at one-time, and is pressed and heated to be fixed by the fixing device 24. After the toner image is transferred onto the intermediate transfer substance 70, the photoconductive substances 1Y, 1M, 1C and 1K is cleaned by the cleaning devices 6Y, 6M, 6C and 6K so that toner remaining on each photoconductive substance at transferring is removed. Then the above cycles of charging, exposing and developing start for subsequent image forming.

<Sheet Conveyance Device>

Figure 2:
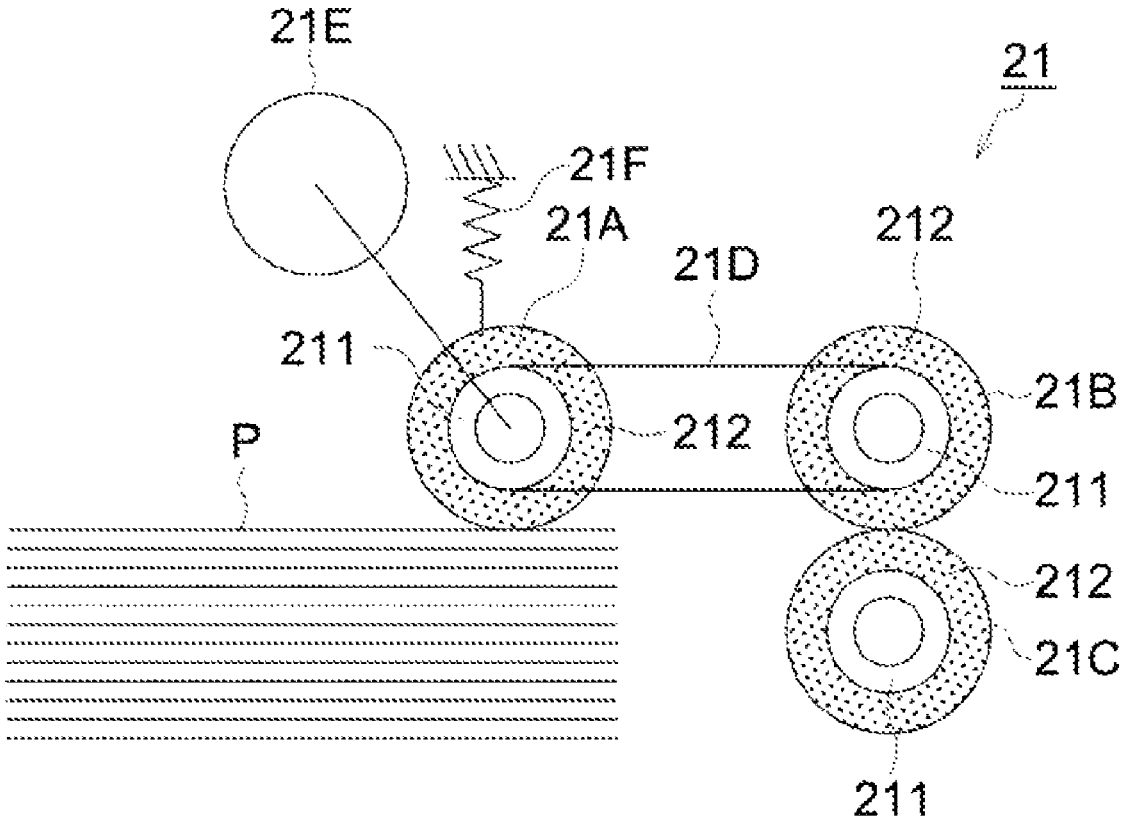
FIG. 2 is a magnified view of a sheet feeding section of a sheet conveyance apparatus related to an embodiment of the present invention.

FIG. 2 is a magnified view of the sheet feeding section 21.

The sheet feeding section 21 is an embodiment of sheet conveyance device related to the present invention, which has a feeding roller 21A representing conveyance rollers of the present invention, a separating and conveyance roller 21B, a separating and sorting roller 21C, a belt 21D and a motor 21E.

Feeding roller 21A, separating and conveyance roller 21B, and separating and sorting roller 21C are respectively configured with a resin core member 211 and a surface layer 212 made of rubber. As the rubber to configure the surface layer 212, EPDM (ethylene—propylene—diene rubber) is used. Besides EPDM rubber, natural rubber, EPM (ethylene—propylene rubber), SBR (Styrene—butadiene rubber) butyl rubber, chlorosulfonated ethylene silicone rubber, urethane rubber, and silicone—ethylene propylene mixed rubber can be used.

Meanwhile, as above-mentioned, basic components of feeding roller 21A, separating and conveyance roller 21B and separating and sorting roller 21C are the core member 211 and the surface layer 212, however configurations such as a thickness of the layer vary with each roller to suite adequately for each roller. The reference numeral 21F denotes a spring, which imposes the feeding roller 21A on the sheet P.

The feeding roller 21A and separating and conveyance roller 21B are connected through the belt 21D and rotated by rotation of the motor 21E so as to convey the sheet P. The separating and sorting roller 21C is driven by the separating and conveyance roller 21B. By function of a torque limiter disposed in the roller 21C, the sheet P conveyed double is conveyed in opposite direction to the conveyance direction.

Figure 3:
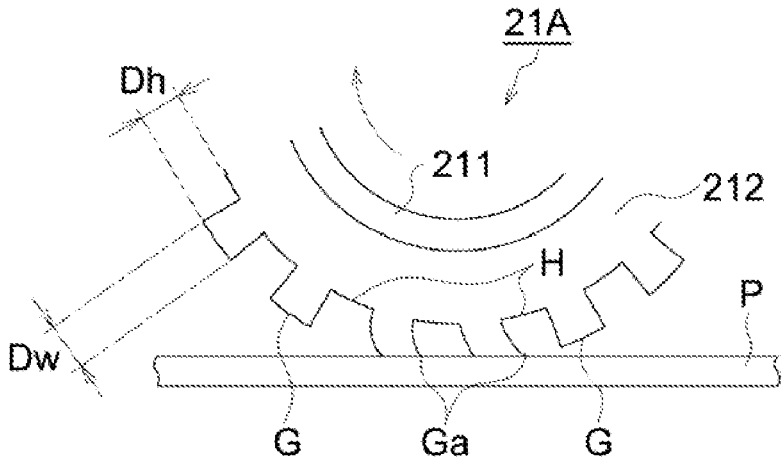
FIG. 3 is a cross-section view of a feeding roller.
Figure 3:
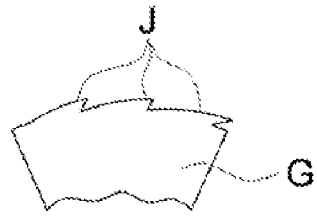

FIG. 3 is a cross-sectional view of the feeding roller 21A representing a conveyance roller.

As FIG. 2(*b*) shows, the surface layer 212 has a surface on which grooves having tread G and bottom H parallel to a rotation axis direction being arranged alternately in the rotation direction are formed. As FIG. 3(*b*) shows, on a surface of the tread G, micro convexo-concaves are formed by roughening with surface treatment so as to obtain an adequate surface roughness as described later. A projection J in FIG. 3(*b*) is formed in an oblique shape in a direction of roughening surface treatment.

Both a width Dw and a depth Dh of the tread G and the bottom H are preferable to be 0.5 mm to 1.0 mm mutually.

The surface layer 212 having the tread G and the bottom H is formed by molding the rubber.

After molding, as FIG. 3(*b*) shows, the surface of the tread G is roughen by surface treatment so as to obtain an appropriate surface roughness.

Figure 4:
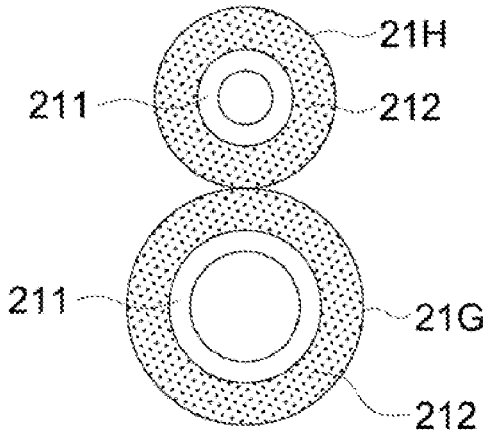
FIG. 4 is a view showing other example of a sheet conveyance apparatus related to an embodiment of the present invention.

FIG. 4 shows other example of the sheet conveyance apparatus related to an embodiment of the present invention.

In the present example, the sheet conveyance device is configured with a drive roller 21G and a driven roller 21H.

The roller 21G and the roller 21H have the core members 211 and the surface layers 212 made of rubber respectively. The roller 21G and the roller 21H grasp and convey the sheet P. The drive roller 21G has the appropriate surface roughness as described in the following. The sheet conveyance device in FIG. 4 can be used as the resist roller 23 in FIG. 1.

<Design of the Sheet Conveyance Device>

Figure 5:
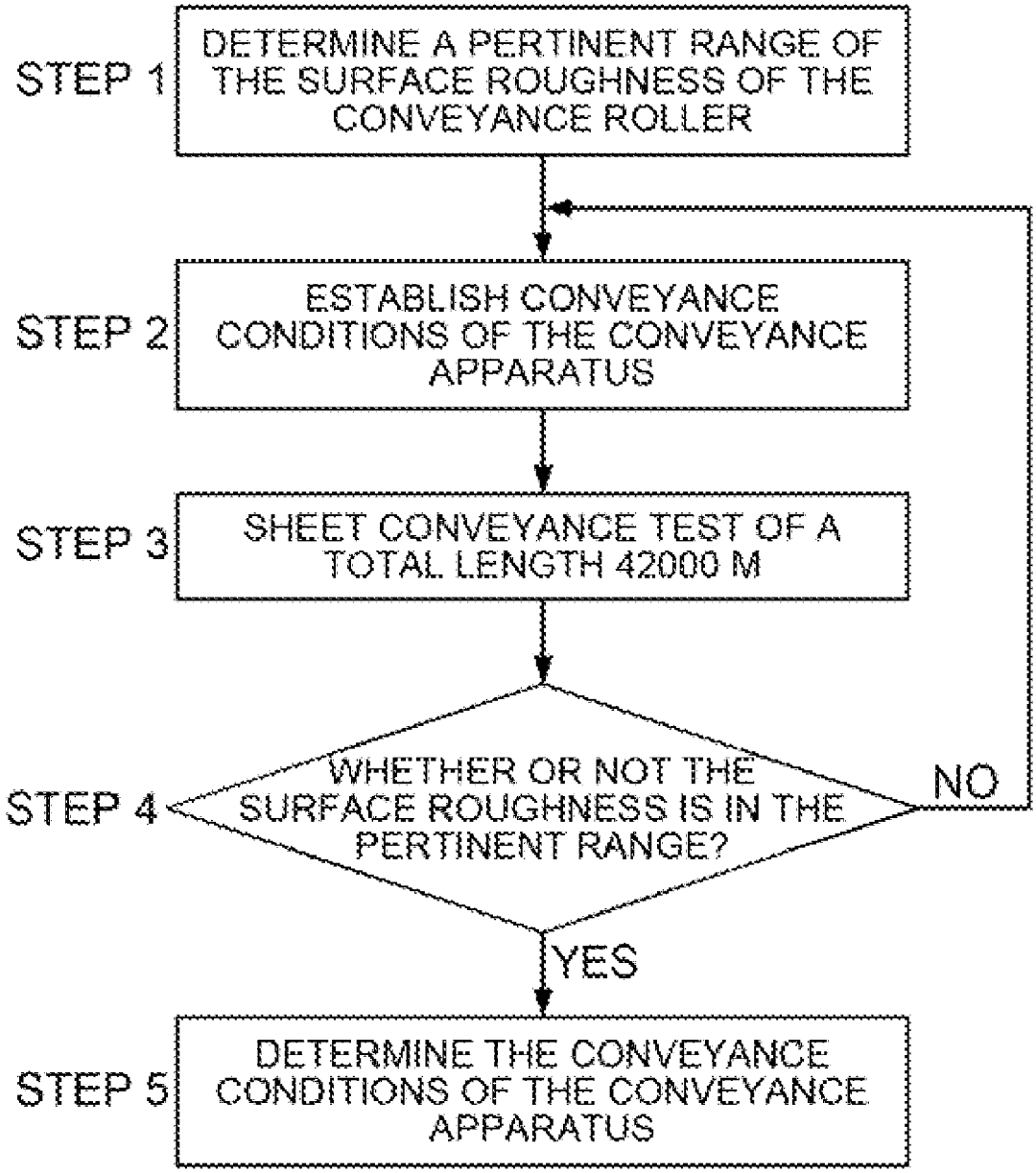
FIG. 5 is a diagram showing a design process of a sheet conveyance apparatus related to an embodiment of the present invention.

FIG. 5 shows a design process of the sheet conveyance device related to the embodiment of the present invention.

In STEP 1, pertinent surface conditions of a sheet conveyance roller are established.

Appropriate conveyance performance of the conveyance roller can be realized by assigning a pertinent value to the surface roughness Ra.

Therefore, in STEP 1 a tolerance of surface roughness to ensure a necessary conveyance performance is assigned.

As the surface roughness, Ra is used. The surface roughness Ra is defined by JIS B 0601-1994 and the value thereof is measured by the following method.

An axis direction line roughness of the roller is measured for a measuring area of 1 mm in a roller axis direction by 0.5 mm in a circumferential direction through a confocal laser microscope model: VK-8500 manufactured by KEYENCE Corporation with 2 μm lens having magnification ratio of 10.

The tolerance of Ra is 8 μm to 30 μm and preferably 15 μm to 30 μm.

Such tolerance can be obtained in data accumulated in the past and can be obtained from an experiment.

The tolerance in STEP 1 is a tolerance where preferable conveyance can be realised for all kinds of sheets which the sheet conveyance device conveys.

For a sheet conveyance device assembled in an image forming apparatus for POD, there is assigned a tolerance Ra which enables preferable conveyance of a coated sheet having the most severe conveyance conditions.

The conveyance roller has a tendency that the surface becomes a mirror surface by a friction due to conveyance of the sheet, however under some conveyance conditions, the convexoconcave structure is maintained, the surface roughness is not deteriorated, and conveyance performance is maintained irrespective of the friction.

In STEP 2, the conveyance conditions by which the surface roughness is not deteriorated through operation is searched.

Next, such conveyance conditions will be described as follow:

With conventional rubber roller, the surface of the roller which is worn through a consecutive sheet conveyance becomes very smooth and in some cases, the surface becomes a flat surface (surface roughness Ra is 2 μm to 6 μm) having glassing.

Contrarily, by giving appropriate values to a hardness of the rubber and to a contact pressure in a way that the rubber hardness is lowered and the roller contact pressure is increase, the roller surface wears maintaining a state of rough grinding, thus the convexo-concave on the roller surface is maintained through continuous sheet conveyance. Namely, even after long time operation, the roller surface roughness Ra of not less than 8 μm is maintained and a sufficient conveyance force is maintain. Therefore slip during conveyance of the coated sheet can be well prevented.

By maintaining the surface roughness Ra of particularly not less than 15 μm, extremely high conveyance performance can be maintained for a long period of time.

However, if the surface roughness of the roller surface Ra is excessively rough, a wearing speed of the roller becomes excessively high and durability is deteriorated. Thus the surface roughness after conveyance of 20,000 or 30,000 sheets is preferred to be 30 μm or less.

By selecting the rubber hardness of the rubber forming the surface layer of the conveyance roller and the contact pressure of the roller appropriately, the surface roughness Ra can be maintained in a necessary range for a long period of time, however, if the rubber hardness is lowered excessively, the roller becomes fragile and the roller is damaged merely by contacting with users hand or an edge of thick paper. Also, if the contact pressure is set too high, double feeding or damages of the sheets occur easily.

Therefore, it is preferred that grooves having a depth and width of 0.5 mm to 1 mm are provided on the conveyance roller surface in parallel to a roller rotation axis direction.

Namely, it is preferred to provide both the tread G and the bottom H having the depth and the width of 0.5 mm to 1 mm (refer FIG. 3).

With such grooves, the contact area of the conveyance roller in respect to the sheet is decreased thereby a high pressure can be obtained though the pressing force is low. Thus the surface roughness Ra can be maintained in the appropriate range.

Also as Ga in FIG. 3(*a*) shows, an edge formed by a borderline between the tread G and bottom H is pressed by being in contact with the sheet and is deformed, thus the convexo-concave J in a shape of scale or cockle as shown by FIG. 3(*b*) is formed thus the friction resistance required for the conveyance roller is maintained.

In a sheet conveyance test, the surface roughness Ra of 8 μm to 30 μm was maintained through 300,000 pieces of A4 sheet.

The hardness of rubber is determined by selecting the rubber material. Regarding a contact pressure of the conveyance roller in respect to the sheet, in an example shown by FIG. 2, a sum of a pressure via a spring 21F and a weight of the feeding roller 21A becomes the contact pressure. Thus the contact pressure can be set at an appropriate value by adjusting the pressure of the spring 21F.

In STEP 3, a durability test where 200,000 pieces of A4 size sheet is conveyed in a lateral direction is carried out.

In the durability test, while plain paper is conveyed in the lateral direction (a convey direction parallel to short side), types of the paper do not affect the wear of the conveyance roller much. Therefore, other paper than the plain paper can be used except for extremely rough paper and irregular paper which may cause conveyance trouble. Also, other size of sheet than A4 size can be used for the durability test if the total length is 42,000 m which is equivalent to 200,000 pieces of A4 size sheet.

In STEP 4, whether or not the roughness Ra of the roller surface after the durability test is within the tolerance is inspected.

If the measurement surface roughness is within the tolerance (STEP 4 "Yes"), the test is terminated and the conveyance conditions established in STEP 2 is set in the sheet conveyance apparatus.

If the measurement surface roughness is not with in the tolerance (STEP 4 "No"), Returning to STEP 2, conveyance conditions are reestablished.

By repeating STEP 2 to STEP 4 until the surface roughness after the durability test remains fails within the tolerance, the conveyance conditions of the sheet conveyance apparatus to enable that the surface roughness of the conveyance roller after conveying the sheets equivalent to 200,000 pieces of A4 sheets remains within the tolerance are detected and the conveyance conditions are determined in STEP 8.

The conveyance conditions determined in STEP 5 are conditions to maintain the surface roughness required by the conveyance roller when 200,000 sheets are printed. Thereby preferable conveyance performance for 200,000 sheets is ensured, thus this conveyance condition is used in manufacturing the sheet conveyance apparatus as a designed value of the sheet conveyance apparatus.

The sheet conveyance device in which the conditions established through STEPS 1 to 5 are set is able to carry out preferable conveyance of a slippery sheet such as the coated paper up to 200,000 pieces from the beginning without fail.

As a method to establish the conveyance conditions, besides the method shown by FIG. 5, there can be a method that while changing the hardness of the conveyance roller rubber and the contact pressure, conveyance test equivalent to 200,000 pieces of A4 size sheet is carried out, then the roller surface roughness Ra is measured after the durability test and then the conditions to enable the surface roughness Ra at 200,000 sheets to be within the tolerance is calculated based on a plurality of measurement values.

Using the conveyance roller shown by FIG. 3 as the feeding roller 21A in the feeding section 21 of the image forming apparatus shown by FIG. 1, conveyance performance was evaluated by measuring the surface roughness of the feeding roller 21A at each stage with the following sheet conveyance conditions:

FIG. 6 shows a surface state after 200,000 pieces of A4 size sheets were conveyed by the conveyance roller of the sheet conveyance apparatus related to the embodiment of the present invention.

In the embodiment, based on conveyance conditions shown by FIG. 5, EPDM is used as the rubber material of the surface layer, then the hardness is set at 27° (by JIS K6253, the same hereafter) and the contact pressure is set at 50N/m$^2$.

FIG. 6(*a*) and FIG. 6(*b*) show profiles of cross sections between two points having distance of 700 μm in a direction parallel to the rotation axis direction of the feeding roller 21A. FIG. 6(*a*) and FIG. 6(*b*) are profiles at different positions in the roller rotation direction.

A surface state of an unused conveyance roller, namely an initial stage after surface treatment, is shown in FIG. 7.

FIG. 8 shows a surface state of the conveyance roller in a comparison example 1.

In the comparison example, the conveyance conditions are established without processing through the establishing process of the conveyance conditions shown in FIG. 5. The conveyance conditions were that the rubber material of the surface layer was SPDM having the hardness of 35° and the contact pressure was 25N/m$^2$.

The surface state of initial stage of the conveyance roller used in the comparison example in FIG. 8 is as shown in FIG. 7. After 200,000 pieces was conveyed, the surface state was changed as FIG. 8 shows.

FIG. 9 shows the surface state of the conveyance roller in an initial unused stage to be used in comparison example 2.

Rubber merely molded without having surface treatment is used in the surface layer of the conveyance roller in FIG. 9.

Meanwhile, in the same manner as FIG. 6, FIG. 7 to 9, show profiles of cross sections between two points having distance of 700 μm in a direction parallel to the rotation axis direction of the feeding roller 21A. FIG. 7(*a*) to FIG. 9(*a*) and FIG. 7(*b*) to FIG. 9(*b*) are profiles at different positions in the roller rotation direction.

As figures shows, the surface roughness Ra of conveyance roller shown in FIG. 6 is 16.24 μm and 23.714 μm, and the surface roughness Ra of conveyance roller shown in FIG. 7 is as high as 13.202 μm and 18.369 μm, and also the profile shows a preferable convexo-concave.

Contrarily, the surface roughness Ra of the conveyance roller in FIG. 3 is 5.863 μm and 8.130 μm, and the profile shows less convexo-concave.

Similarly to FIG. 8, the surface roughness Ra of the conveyance roller in FIG. 9 is as low as 5.547 μm and 4.700 μm, and the profile shows less convexo-concave.

Using the conveyance rollers shown in FIG. 6 to FIG. 9, conveyance of the coated sheet was carried out. A conveyance test result is shown in Table 1.

TABLE 1

| | Sheet slip in initial stage | Sheet slip after 42,000 m is conveyed |
|---|---|---|
| Embodiment | No | No |
| Comparison example 1 | No | Disable to convey |
| Comparison example 2 | Slip occurred | Disable to convey |

Figure 10:
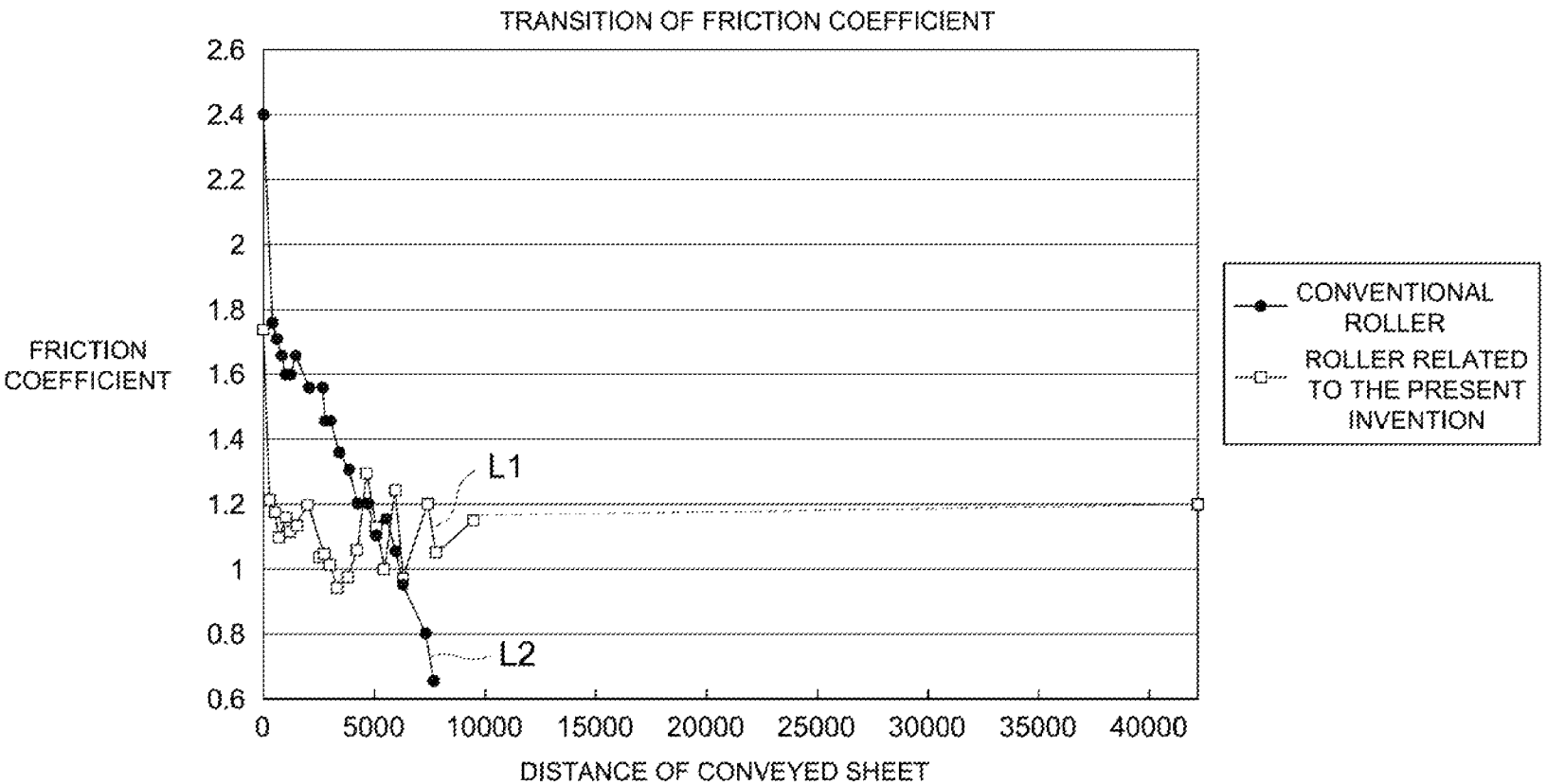
FIG. 10 shows friction resistances of conveyance rollers in an embodiment and a comparison example 1.

FIG. 10 shows a transition of a friction resistance of the conveyance rollers of the embodiment and the comparison example 1 in respect, to the coated sheet.

In the embodiment denoted by a curve line L1, the friction resistance was in an appropriate range through out sheet conveyance of 420,000 mm and preferable conveyance was carried out. However, in the comparison example 1 denoted by a curve line L2, the friction resistance dropped below an allowable value at sheet conveyance distance of 7,800 m and conveyance was disabled.

According to the above embodiments, since the surface roughness of the conveyance roller is 8 μm to 30 μm at a stage where conveyance length of sheet reaches 42000 m which is equivalent to lateral feeding (conveyance in a direction of short side) of 200,000 pieces of A4 sheets, the conveyance force for various kinds of sheets including coated sheet can be ensured, and preferable and stable sheet conveyance can be performed for the life-span time or for the interval of maintenance.

What is claimed is:

1. A sheet conveyance apparatus, comprising:

a conveyance roller in contact with a sheet with pressure to convey the sheet having a surface layer made up of rubber on which grooves having widths and depths of 0.5 to 1 mm are formed parallel to a rotation axis of the conveyance roller, wherein the surface layer is processed so that an initial value of surface roughness Ra is in a range from 8 μm to 30 μm.

2. The sheet conveyance apparatus of claim 1, wherein the surface layer is made up of EPDM (Ethylene—propylene—diene rubber).

3. The sheet conveyance apparatus of claim 1, wherein the conveyance roller conveys the sheet by contacting with a top surface of the sheets piled up with a pressure.

4. The sheet conveyance apparatus of claim 1, wherein the conveyance roller is configured with a pair of rollers and at least one of the rollers has the surface layer.

5. An image forming apparatus, comprising:

an image forming section to form an image; and a sheet feeding section having a feeding roller to feed a sheet to the image forming section; wherein the feeding roller has a surface layer made up of rubber on which grooves having widths and depths of 0.5 to 1 mm are formed parallel to a rotation axis of the conveyance roller, wherein the surface layer is processed so that an initial value of surface roughens Ra is in a range from 8 μm to 30 μm.

6. The sheet conveyance apparatus of claim 5, wherein the surface layer is made up of EPDM (Ethylene—propylene—diene rubber).

* * * * *